US012130027B2

(12) United States Patent
Chen et al.

(10) Patent No.: US 12,130,027 B2
(45) Date of Patent: Oct. 29, 2024

(54) SUBMERGED CONDENSERS AND HEAT PUMP WATER HEATERS INCLUDING SAME

(71) Applicant: Rheem Manufacturing Company, Atlanta, GA (US)

(72) Inventors: Hongchu Chen, Montgomery, AL (US); Atilhan Manay, Waterbury, CT (US); Vishwanath Ardha, Montgomery, AL (US); Divakar Mantha, Montgomery, AL (US)

(73) Assignee: Rheem Manufacturing Company, Atlanta, GA (US)

( * ) Notice: Subject to any disclaimer, the term of this patent is extended or adjusted under 35 U.S.C. 154(b) by 48 days.

(21) Appl. No.: 17/530,945

(22) Filed: Nov. 19, 2021

(65) Prior Publication Data

US 2022/0163219 A1 May 26, 2022

Related U.S. Application Data

(60) Provisional application No. 63/116,587, filed on Nov. 20, 2020.

(51) Int. Cl.
*F24D 3/18* (2006.01)
*F24H 4/04* (2006.01)
(Continued)

(52) U.S. Cl.
CPC ..... *F24D 3/18* (2013.01); *F24H 4/04* (2013.01); *F24H 9/1809* (2013.01); *F25B 39/04* (2013.01); *F25B 2339/047* (2013.01)

(58) Field of Classification Search
CPC ..... F24D 3/18; F24D 17/02; F25B 2339/047; F25B 39/04; F24H 4/04; F24H 9/1809; F24H 9/133
See application file for complete search history.

(56) References Cited

U.S. PATENT DOCUMENTS 743,719 A * 11/1903 Henkle ..... F24H 9/133 122/18.4
RE17,866 E * 11/1930 Arthur ..... B21D 39/04 126/362.1
(Continued)

FOREIGN PATENT DOCUMENTS

DE 2604942 A1 8/1977
DE 3422806 A1 1/1986
(Continued)

OTHER PUBLICATIONS

International Search Report and Written Opinion for PCT Application No. PCT/US2021/058386 mailed Feb. 17, 2022.
(Continued)

*Primary Examiner* — Christopher R Zerphey
(74) *Attorney, Agent, or Firm* — Eversheds Sutherland (US) LLP

(57) ABSTRACT

A condenser assembly is disclosed. The condenser assembly can include a condenser coil having a first portion and a second portion. The first portion can be configured to fluidly communicate with a first refrigerant line of a heat pump, and the first portion can have a plurality of windings defining an internal volume. The second portion can be configured to fluidly communicate with a second refrigerant line of the heat pump. The condenser coil can be configured to at least partially insert into an internal volume of a water heater tank.

20 Claims, 15 Drawing Sheets

(51) Int. Cl.
*F24H 9/1809* (2022.01)
*F25B 39/04* (2006.01)

(56) References Cited

U.S. PATENT DOCUMENTS

| | | | | | |
|---|---|---|---|---|---|
| 1,790,357 | A * | 1/1931 | Stack | F24D 17/00 | 122/20 A |
| 2,038,476 | A * | 4/1936 | Clark | F24H 15/174 | 219/486 |
| 2,602,465 | A * | 7/1952 | Goehring | B65D 88/54 | 239/524 |
| 4,173,872 | A * | 11/1979 | Amthor, Jr. | F24H 4/04 | 392/308 |
| 4,257,355 | A * | 3/1981 | Cook | F24H 1/205 | 122/18.31 |
| 4,293,323 | A * | 10/1981 | Cohen | F24H 4/04 | 165/142 |
| 4,370,864 | A * | 2/1983 | Wessa | F25B 39/04 | 62/98 |
| 4,409,796 | A | 10/1983 | Lake, Jr. | | |
| 4,505,231 | A * | 3/1985 | Syler | F24H 9/0042 | 122/159 |
| 4,510,922 | A * | 4/1985 | Roussos | F24D 11/003 | 126/646 |
| 4,773,231 | A * | 9/1988 | Sulzberger | F24H 4/04 | 62/238.6 |
| 4,838,211 | A * | 6/1989 | Vago | F24H 9/133 | 137/15.01 |
| 4,898,124 | A * | 2/1990 | Granberg | F24H 9/133 | 122/382 |
| 5,671,771 | A * | 9/1997 | Brandel | F24D 17/0078 | 122/13.3 |
| 7,634,976 | B2 * | 12/2009 | Gordon | F28D 20/0039 | 122/14.3 |
| 7,866,168 | B2 | 1/2011 | Gordon et al. | | |
| 11,768,012 | B2 * | 9/2023 | Rendall | F24H 9/0015 | 122/14.3 |
| 2009/0266509 | A1 * | 10/2009 | Pussell | F28D 7/024 | 165/47 |
| 2014/0363146 | A1 * | 12/2014 | Compton | F28F 9/0246 | 392/441 |
| 2016/0109156 | A1 | 4/2016 | Yin | | |
| 2019/0041882 | A1 | 2/2019 | Noboa et al. | | |
| 2019/0338974 | A1 | 11/2019 | Turney et al. | | |

FOREIGN PATENT DOCUMENTS

| | | | |
|---|---|---|---|
| FR | 2455254 | A1 | 11/1980 |
| RU | 75015 | U1 | 7/2008 |
| WO | 2014/141724 | A2 | 9/2014 |
| WO | 2014/115903 | A1 | 6/2015 |

OTHER PUBLICATIONS

International Search Report and Written Opinion for PCT Application No. PCT/US2021/060101 mailed Feb. 17, 2022.

* cited by examiner

FIG. 3G
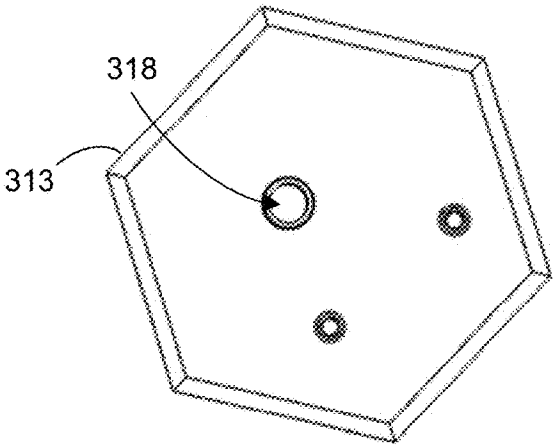
FIG. 3H
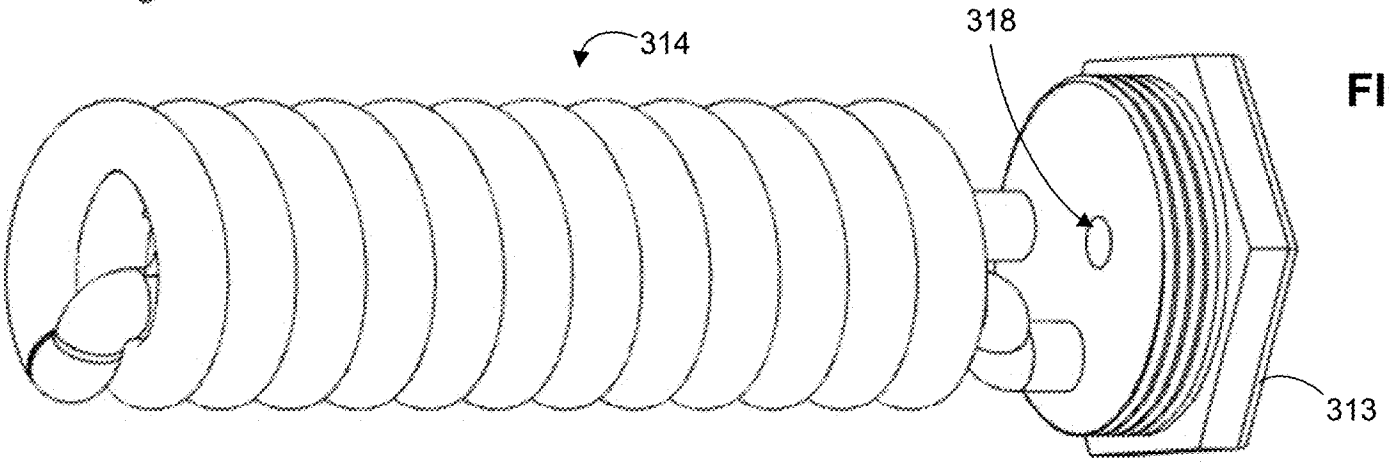
FIG. 3F
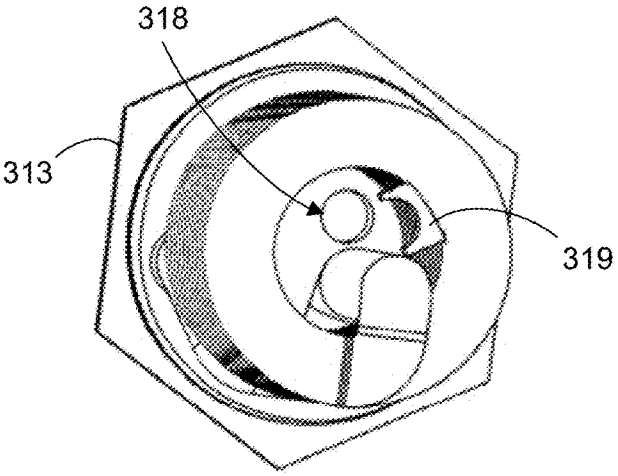
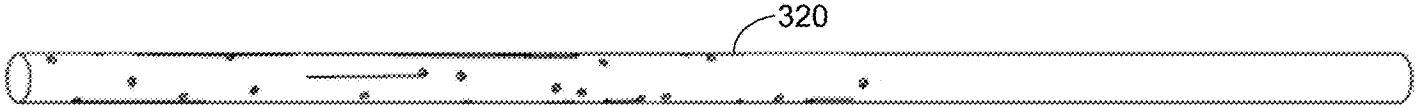
FIG. 3I

SUBMERGED CONDENSERS AND HEAT PUMP WATER HEATERS INCLUDING SAME

CROSS-REFERENCE TO RELATED APPLICATIONS

This application claims the benefit, under 35 U.S.C. § 119, of U.S. Provisional Patent Application No. 63/116,587, filed 20 Nov. 2020, the entire contents and substance of which is incorporated herein by reference in its entirety as if fully set forth below.

BACKGROUND

Existing heat pump water heaters available in the market typically employ a condenser 12 that is wrapped around the exterior of the tank 14, such as the heat pump water heater 10 illustrated in FIG. 1. Such external, wrap-around condenser designs are often employed because the condenser coil is not in contact with water, thus eliminating any corrosion and scaling from forming on the condenser coil's surface. This configuration, however, permits only a small amount of the tube surface area of the condenser coil 12 to contact the tank wall. More specifically, the upper limit of the tube that can contact the tank wall is typically approximately one-third of the tube surface area. The remaining two-thirds of the tube surface area is typically in contact with a foam insulation material that surrounds the tank. As such, this configuration can lead to heat loss from hot refrigerant to ambient via the insulation.

In addition, to provide sufficient heat to the contents of the tank, such configurations generally require an increased tubing length to compensate for the low effective heat transfer area and total tube surface area ratio of the condenser tube. And to provide sufficient heating, the long condenser coil 12 is typically wrapped around a significant portion of the tank 14.

Further, because other components are typically attached to, or positioned near, the tank's exterior, the condenser tube is often required to be wrapped or wound in a non-uniform fashion. An example of such non-uniform wrapping being necessitated by the positioning of other components is illustrated at the lower portion of the condenser coil 12 in FIG. 1. This non-uniformity can add to the complexity of the condenser coil 12 and the overall water heater 10, which in turn increases the difficulty, time, and cost associated with manufacturing the water heater 10.

Further still, the long tube length used for the external wrap-around condenser coil 12 can require an increase in the inner diameter of the tube to maintain pressure drop and therefore increase the amount of refrigerant charge in the condenser coil 12 necessary to provide sufficient heating. As to the type of refrigerant that can be used within the refrigerant circuit (including the condenser coil 12), some locations have strict governmental regulations requiring the use of low global warning potential (GWP) refrigerants. However, refrigerants having a low GWP index tend to be flammable. And to satisfy other governmental regulations limiting flammability, the refrigerant charge of the refrigerant circuit is often required to be reduced. Thus, there is often a high degree of difficulty in designing water heaters with wrap-around condenser coils because the refrigerant used should be a low-GWP refrigerant and the charge of the system should be great enough to provide sufficient heating, while low enough to accommodate flammability regulations applicable to the water heater system.

SUMMARY

These and other problems are addressed by various aspects of the technology disclosed herein. The disclosed technology include a condenser assembly comprising a condenser coil having a first portion and a second portion. The first portion can be configured to fluidly communicate with a first refrigerant line of a heat pump, and the first portion can have a plurality of windings defining an internal volume. The second portion can be configured to fluidly communicate with a second refrigerant line of the heat pump.

The plurality of windings of the first portion can form a helix.

The condenser coil can be configured to sequentially pass refrigerant through the first portion and the second portion. Alternatively, the condenser coil can be configured to sequentially pass refrigerant through the second portion and the first portion.

The second portion can include a substantially straight section.

The second portion can extend through the internal volume of the first portion.

Alternatively, the second portion can extend outside the internal volume of the first portion.

The condenser assembly can include a base, and the base can be configured to detachably attach to a receiving port of a water heater. The base can include threads configured to mate with threads of the receiving port.

The base can include a water inlet configured to discharge water into the internal volume of the first portion. For example the base can include an aperture configured to receive a water inlet tube. The water inlet tube can extend through the internal volume of the first portion. The water inlet tube can have a length that is less than or equal to a length of the condenser coil. The water inlet tube can have a plurality of apertures disposed along at least a portion of a length of the water inlet tube. The water inlet tube can have a capped end.

The condenser assembly can include an alignment tab configured to hold the water inlet tube in a predetermined position relative the condenser coil.

Optionally, the base can include a water inlet nozzle (e.g., in lieu of the water inlet tube).

The condenser coil can include an inner wall and an outer wall, and the inner and outer walls can form an air gap therebetween.

The disclosed technology includes a water heater including a tank and a heat pump.

The heat pump can include a refrigerant circuit including a compressor, an evaporator, an expansion valve, a condenser assembly, and a plurality of refrigerant lines. The condenser assembly can include a first portion and a second portion. The first portion can be configured to fluidly communicate with a first refrigerant line of the plurality of refrigerant lines and to at least partially extend into an internal volume of the tank. The first portion can have having a plurality of windings defining an internal volume. The second portion can be configured to fluidly communicate a second refrigerant line of the plurality of refrigerant lines and to at least partially extend into an internal volume of the tank.

The water heater can include a receiving port, and the condenser assembly can be configured to detachably attach to the receiving port.

The receiving port can be located in a sidewall of the water heater.

The water heater can include a water inlet tube extending through the internal volume of the condenser coil such that the water inlet tube extends into the tank from the sidewall of the water heater. Alternatively, the water heater can include a water inlet nozzle configured to discharge incoming water into the internal volume of the condenser coil.

Various other aspects and benefits of the disclosed technology are disclosed more fully herein.

BRIEF DESCRIPTION OF THE FIGURES

Reference will now be made to the accompanying figures, which are not necessarily drawn to scale, and wherein:

FIGS. 3D-3H illustrate views of an example condenser assembly, in accordance with the disclosed technology;

FIG. 31 illustrates an example water inlet tube, in accordance with the disclosed technology;

DETAILED DESCRIPTION

Figure 1:
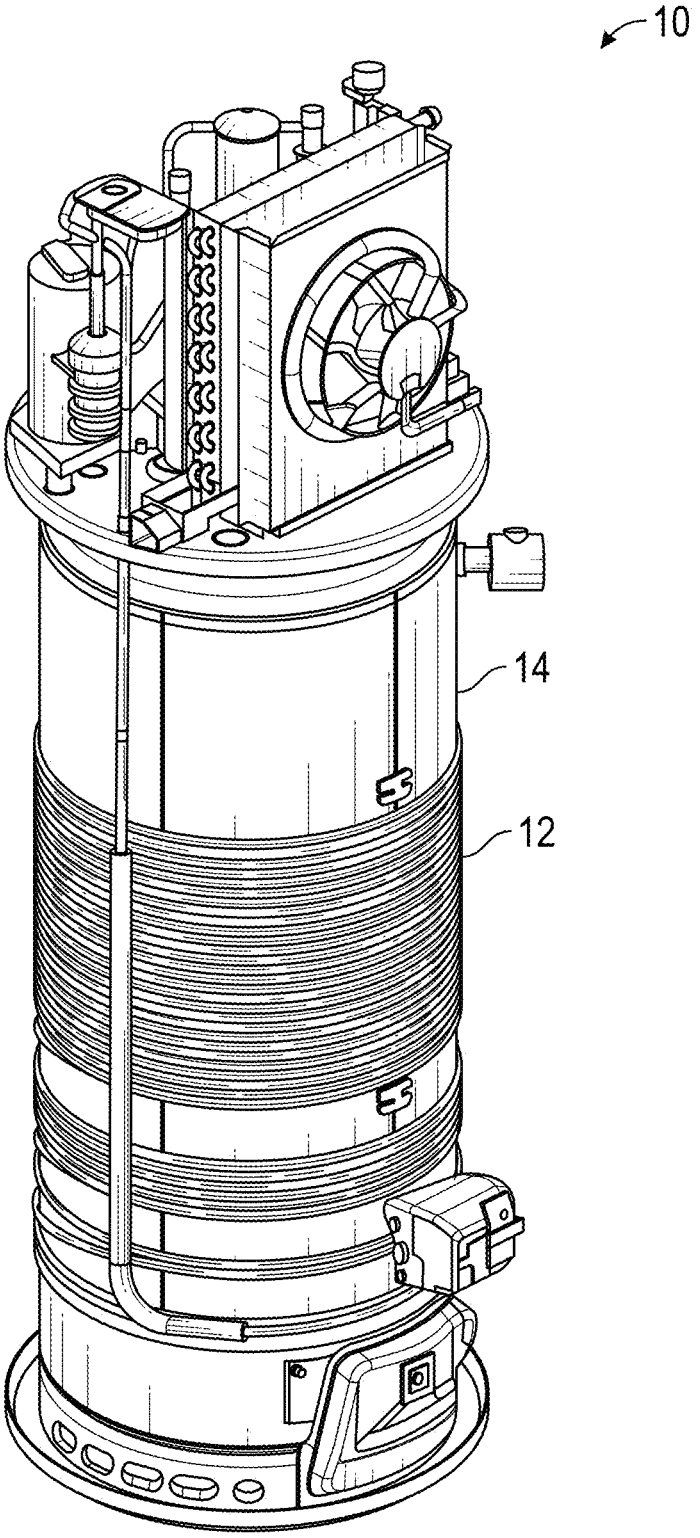
FIG. 1 (Prior Art)
FIG. 1 illustrates a prior art heat pump water heater.
Figure 2A:
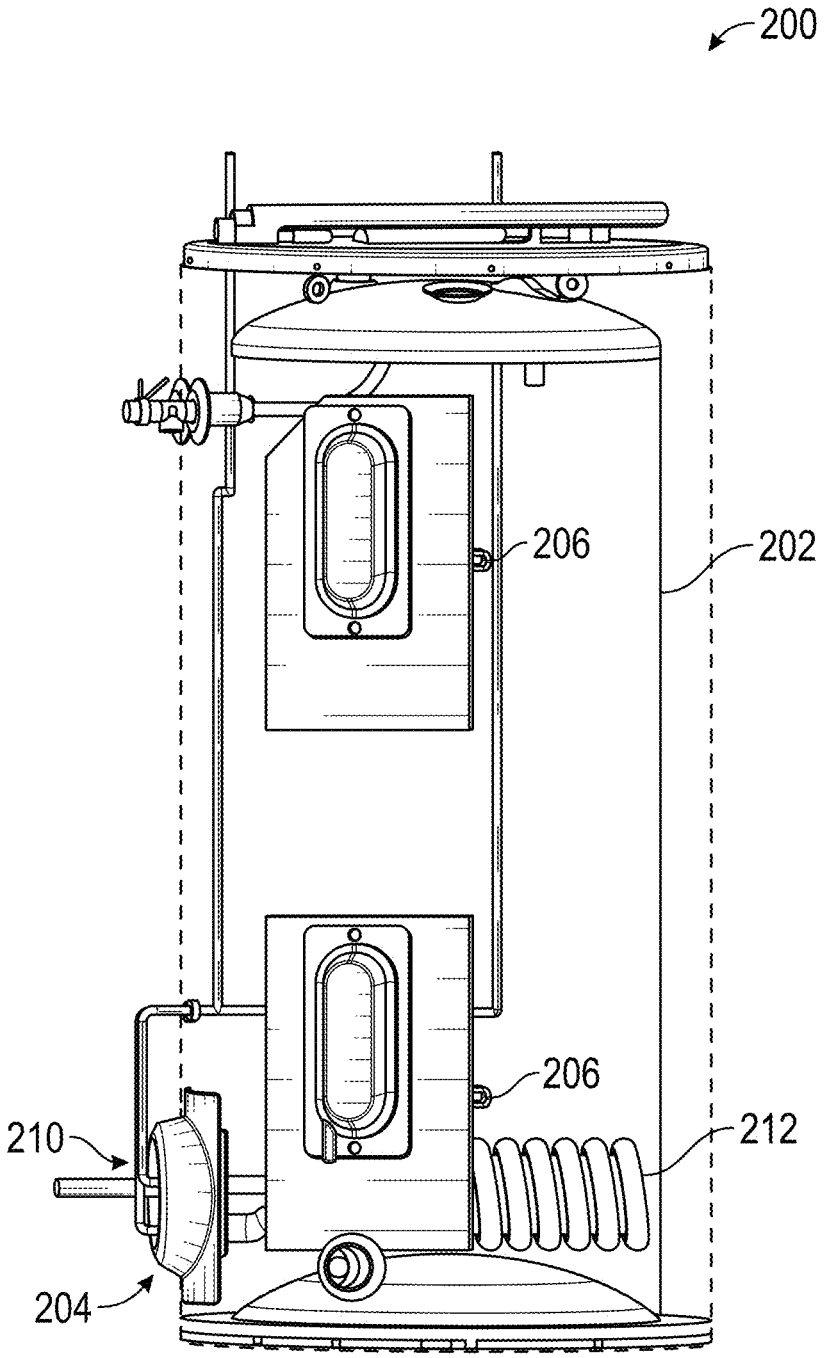
FIGS. 2A and 2B illustrate views of an example heat pump water heater showing the outer shell and the tank wall as transparent for illustrative purposes, in accordance with the disclosed technology.
Figure 2B:
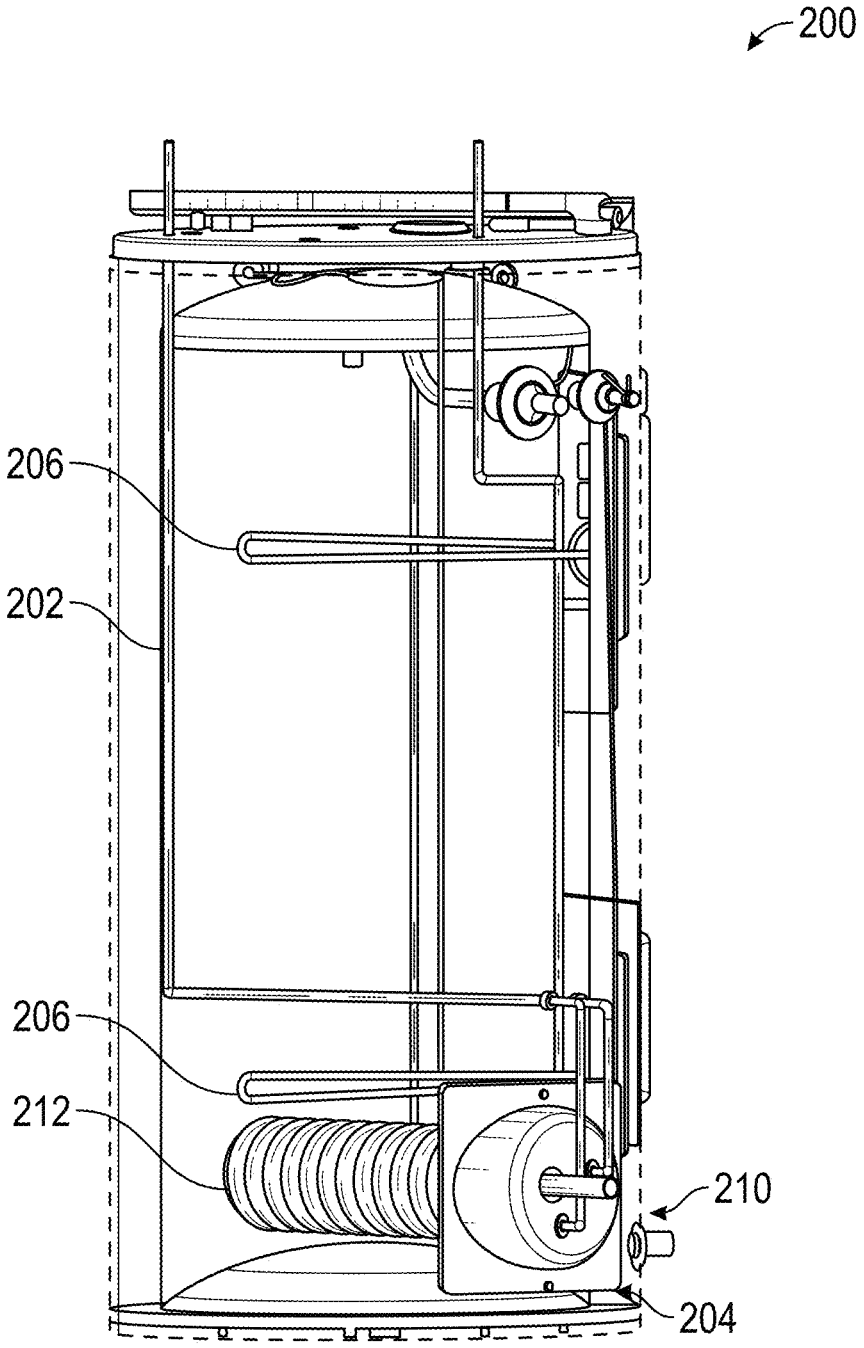
Figure 2C:
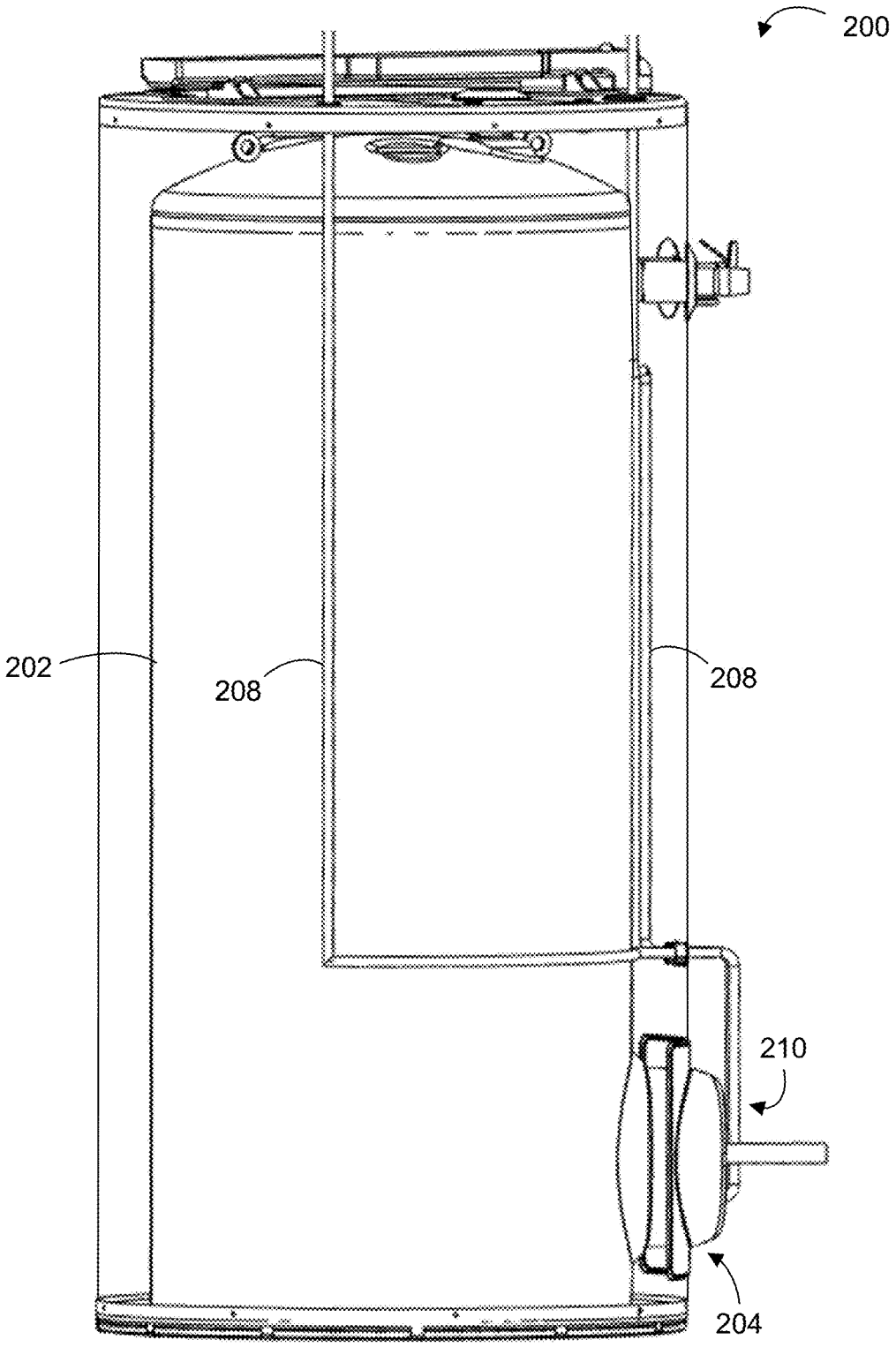
FIG. 2C illustrates an example heat pump water heater showing the outer shell as transparent for illustrative purposes, in accordance with the disclosed technology.
Figure 2D:
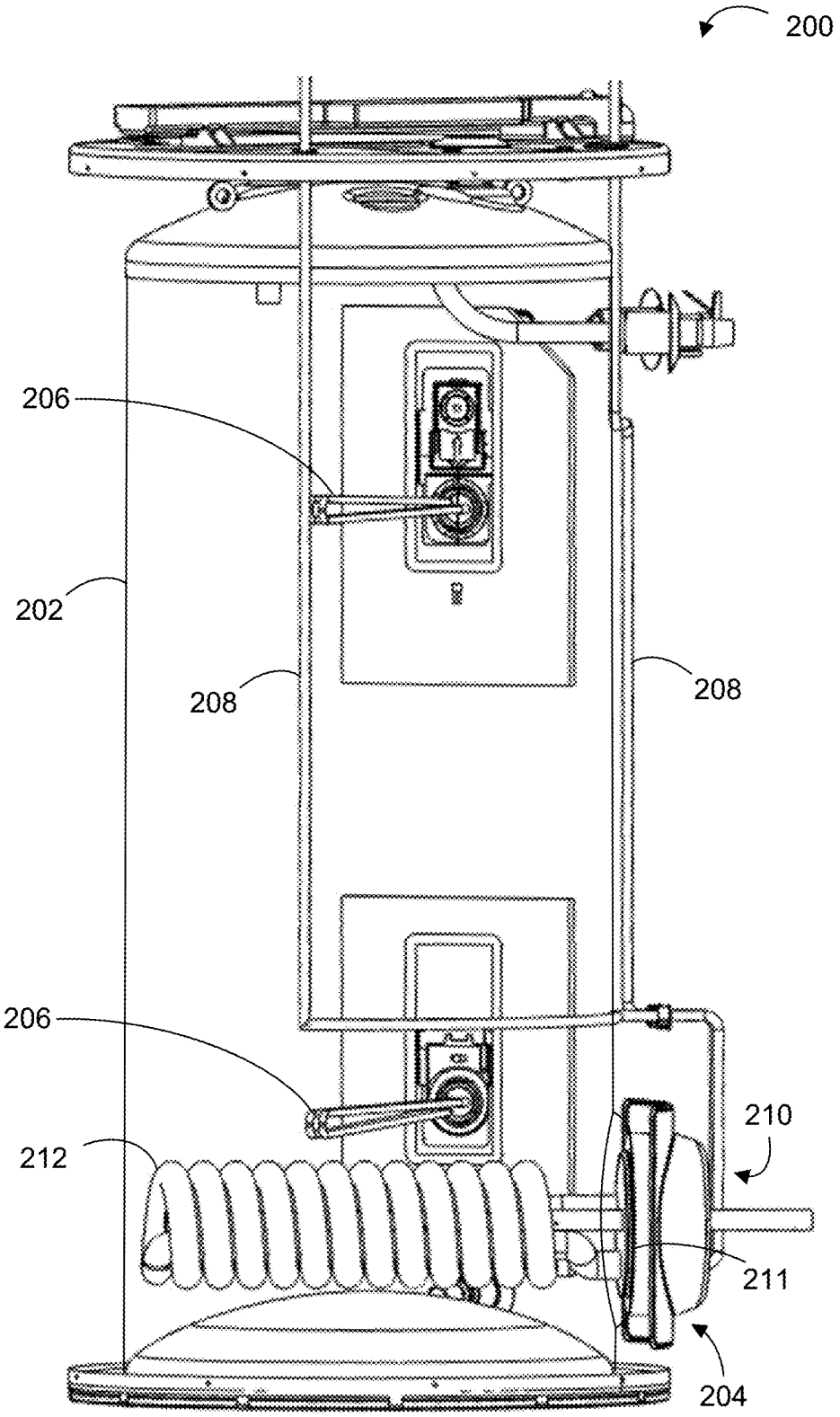
FIG. 2D illustrates an example heat pump water heater with the outer shell omitted and showing the tank wall as transparent for illustrative purposes, in accordance with the disclosed technology.
Figure 2E:
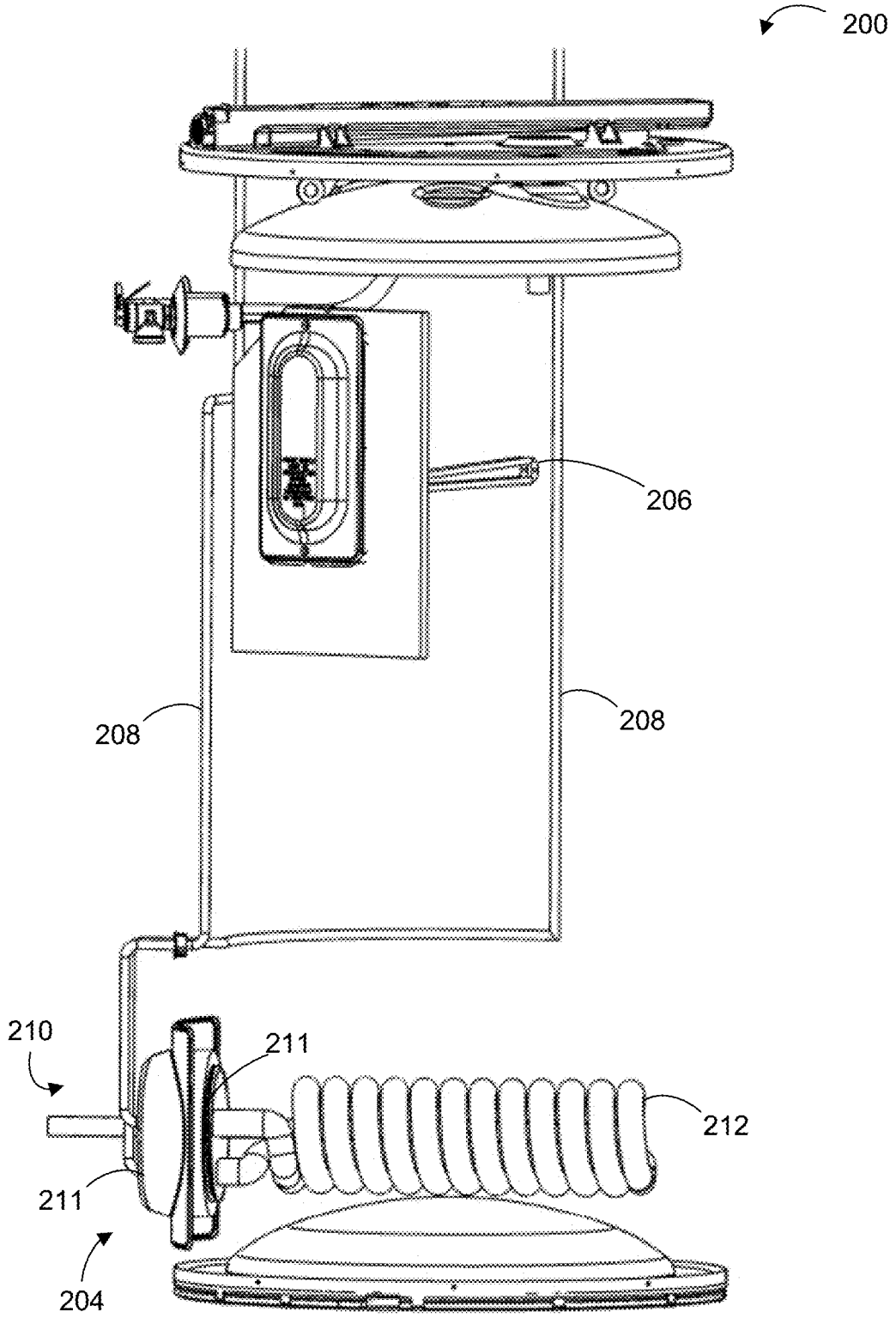
FIG. 2E illustrates an example heat pump water heater with the outer shell and the tank wall omitted for illustrative purposes, in accordance with the disclosed technology.

The disclosed technology relates generally to heat pump water heaters and condenser assemblies for heat pump water heaters. Some examples of the disclosed technology will be described more fully with reference to the accompanying drawings. This disclosed technology may, however, be embodied in many different forms and should not be construed as limited to the implementations set forth herein. The components described hereinafter as making up various elements of the disclosed technology are intended to be illustrative and not restrictive. Indeed, it is to be understood that other examples are contemplated. Many suitable components that would perform the same or similar functions as components described herein are intended to be embraced within the scope of the disclosed electronic devices and methods. Such other components not described herein may include, but are not limited to, for example, components developed after development of the disclosed technology.

Throughout this disclosure, various aspects of the disclosed technology can be presented in a range format (e.g., a range of values). It should be understood that such descriptions are merely for convenience and brevity and should not be construed as an inflexible limitation on the scope of the disclosed technology. Accordingly, the description of a range should be considered to have specifically disclosed all the possible subranges as well as individual rational numerical values within that range. For example, a range described as being "from 1 to 6" includes the values 1, 6, and all values therebetween. Likewise, a range described as being "between 1 and 6" includes the values 1, 6, and all values therebetween. The same premise applies to any other language describing a range of values. That is to say, the ranges disclosed herein are inclusive of the respective endpoints, unless otherwise indicated.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

In the following description, numerous specific details are set forth. But it is to be understood that embodiments of the disclosed technology may be practiced without these specific details. In other instances, well-known methods, structures, and techniques have not been shown in detail in order not to obscure an understanding of this description. References to "one embodiment," "an embodiment," "example embodiment," "some embodiments," "certain embodiments," "various embodiments," etc., indicate that the embodiment(s) of the disclosed technology so described may include a particular feature, structure, or characteristic, but not every embodiment necessarily includes the particular feature, structure, or characteristic. Further, repeated use of the phrase "in one embodiment" does not necessarily refer to the same embodiment, although it may.

Throughout the specification and the claims, the following terms take at least the meanings explicitly associated herein, unless the context clearly dictates otherwise. The term "or" is intended to mean an inclusive "or." Further, the terms "a," "an," and "the" are intended to mean one or more unless specified otherwise or clear from the context to be directed to a singular form.

Unless otherwise specified, the use of the ordinal adjectives "first," "second," "third," etc., to describe a common object, merely indicate that different instances of like objects are being referred to and are not intended to imply that the objects so described should be in a given sequence, either temporally, spatially, in ranking, or in any other manner.

Reference will now be made in detail to example embodiments of the disclosed technology, examples of which are illustrated in the accompanying drawings and disclosed herein. Wherever convenient, the same reference numbers will be used throughout the drawings to refer to the same or like parts.

As discussed above, traditional condenser coils for heat pump water heaters are wrapped around an external surface of the water heater's tank. This can negatively impact multiple aspects of the water heater. For example, the wrap-around design of the condenser coil can increase the complexity, difficulty, time, and/or cost associated with manufacturing the water heater. As another example, the small amount of surface area contact between the condenser coil and the tank exterior, as well as the fact that heat must be transmitted to the water via the tank wall, can necessitate and increase in the amount of condenser coil tubing required to provide a sufficient amount of heat transfer to the water. As will be apparent to those having skill in the art, the disclosed technology can provide heat directly to water and from all or nearly all of the condenser coil's surface, which can increase the heat transfer efficiency of the condenser coil, as well as the energy efficiency of the overall heat pump. The disclosed technology can thus require a comparatively low amount (e.g., length) of condenser coil tubing to provide the same amount of heating as compared to traditional designs, thereby decreasing the materials costs associated with the manufacturing of the condenser coil and the overall heat pump. Further, the increase in efficiency can enable the condenser coil to have a smaller internal volume as compared to traditional designs. In addition, the disclosed technology can create a forced convection heat transfer environment between the water and refrigerant of the heat pump, as opposed to the natural convection heat transfer environment provided by traditional methods (e.g., the water heater 10 of FIG. 1). As described more fully herein, forced convection can be achieved by introducing cold water at a location that within or near an inner volume of the condenser coil. This can result in water jets creating a moving fluid motion tangential to the condenser coils, and the effect of this phenomenon is, inter alia, a reduced heat transfer area for the condenser coil (as compared to traditional designs), as discussed more fully herein (see, e.g., FIG. 6). In turn, the disclosed technology can require a lesser refrigerant charge as compared to traditional designs, which can reduce the operational cost of the water heater. The decrease in charge can also enable to use of low GWP refrigerants (e.g., propane) notwithstanding any flammability concerns, which can be alleviated by the small charge of the low GWP refrigerant required for operation of water heaters that include the disclosed technology. The decreased tube length of the condenser coil can also decrease the pressure drop of refrigerant across the condenser coil, further increasing the performance of the heat pump and lowering the power required of the heat pump's compressor.

Further, the disclosed technology enables a condenser coil to be quickly and easily installed on a tank (e.g., by insertion into a port located on a side surface of the tank), which can reduce assembly time during manufacturing as compared to the traditional process of preparing a tank's surface and wrapping a condenser coil about the tank, which is generally slow and cumbersome. Further still, the disclosed technology enables a user to easily remove, repair, and/or replace a damaged or malfunctioning condenser. In contrast, existing water heaters (e.g., water heater 10) are often replaced in their entirety when a condenser coil becomes damages, as it difficult to cost-effectively repair or replace the damaged condenser coil (or is impossible altogether).

Referring to FIGS. 2A-2E, a water heater 200 can include a tank 202 and a heat pump system. The heat pump system can include a refrigerant circuit having a compressor, a condenser assembly 210, an expansion valve, and an evaporator. The condenser assembly 210 can be configured to transfer heat between refrigerant passing therethrough and water in the tank 202, and the evaporator can be configured to transfer heat between refrigerant passing therethrough and ambient air. The heat pump system can include a fan or blower configured to pass air across the evaporator.

The condenser assembly 210 can include a base 211 and condenser coil 212, and the condenser assembly 210 can be configured to at least partially insert into the interior of the tank 202 such that the condenser coil 212 can be at least partially submerged in water within the tank 202. The condenser coil 212 can be or include any type of heat transfer coil. As illustrated, the exterior surface of the condenser coil 212 can be smooth, although any other arrangements is contemplated, such as a finned coil. To help prevent scaling and/or corrosion, the condenser coil 212 (e.g., some or all of the exterior surface) can be coated in a nickel-based coating or other coating (e.g., a thermally conductive coating). As a non-limiting example, the condenser coil 212 can be coated in an electroless nickel-based coating, such as the electroless nickel coating discussed in U.S. Pat. No. 11,054,199, the entire contents of which are incorporated herein by reference. The base 211 can be configured to abut or contact an exterior surface of the tank 202 and/or water heater 200 when the condenser assembly 210 is installed. For example, the base 211 can be configured to attach to the periphery of a port 204 of the tank 202 (described more fully herein), and/or the base 211 can include a cover portion configured to attach to the exterior surface of the water heater 200 when installed.

Although the figures illustrate the inclusion of a single condenser assembly 210, it is contemplated that two or more condenser assemblies 210 can be included. For example, the water heater 200 can include a first condenser assembly 210 at a first height and a second condenser assembly 210 at a second height that is greater than the first height. If multiple condenser assemblies 210 are included, the condenser assemblies 210 can each be configured to pass refrigerant therethrough simultaneously. Alternatively or in addition, each condenser assembly 210 can be configured to pass refrigerant therethrough selectively and/or independently of one or more other condenser assemblies 210. For example, the heat pump system can include one or more valves (e.g., three-way valve(s), solenoid valve(s)) to selectively permit the flow of refrigerant through one or more sub-circuits with each sub-circuit being associated with a corresponding condenser assembly, as a non-limiting example. Various combinations of the condenser assemblies 210 can be activated simultaneously or sequentially by selectively directing refrigerant thereto (e.g., by opening/closing one or valves, such as a valve corresponding to each condenser assembly 210) depending the on the stratification strategy and/or temperature profile required for the tank 202, for example.

Refrigerant lines 208 can extend between the condenser assembly 210 and other components of the heat pump, such as the compressor and the expansion valve. One refrigerant line 208 can be configured to transport refrigerant from the compressor to the condenser assembly 210, and another refrigerant line 208 can be configured to transport refrigerant from the condenser assembly 210 to the expansion valve. The refrigerant lines 208 can extend along an exterior of the tank 202. At least a portion of one or more of the refrigerant lines 208 can be in contact with an exterior surface of the tank 202. Alternatively, one or both of the refrigerant lines 208 can be spaced apart from the tank 202 (e.g., to prevent unwanted heat transfer between the refrigerant and the tank 202. The refrigerant lines can be insulated outside of the tank and/or can be buried in a foam or another insulation between the tank 202 and the outer shell of the water heater 200.

The water heater 200 can include a port 204 for receiving the condenser assembly 210. The port 204 can be located at any desired location. As illustrated, the port 204 can be located on a side (e.g., a vertically extending surface) of the water heater 200. Alternatively, the port 204 can be located on a top surface of the water heater 200 or at any other location on the water heater 200.

As illustrated, the water heater 200 can include one or more supplemental heating devices 206, such as the illustrated electrical heating elements. Thus, the water heater 200 can include one or more condenser coils 212, and the water heater 200 can optionally include one or more supplemental heating devices 206.

The water heater 200 can include a water inlet configured to receive water and a water outlet configured to discharge heated water. The water inlet can include a dip tube (i.e., a tube vertically extending from a top surface of the water heater and configured to input water into a lower portion of the tank). Alternatively or in addition, the water inlet can include a water inlet tube extending into the tank 202 in a generally radially inward direction (with respect to a central axis of the tank 202) (e.g., water inlet tube 320, as described more fully herein). Stated otherwise, a central axis of the water inlet tube can intersect a central axis of the tank 202 (e.g., at a 90° angle or any other intersecting angle).

As can be see mostly clearly in FIGS. 3A-3H, the condenser assembly 210 can include a condenser coil 212 that is wrapped in a helical or spiral configuration. The condenser coil 212 can include two or more windings. As a non-limiting example, the condenser coil 212 can include twelve windings, as illustrated. However, any other number of windings can be included, such as five, ten, fifteen, twenty, or any other number of windings. The condenser coil 212 can be wound such that the overall diameter of the condenser coil 212 is smaller than the diameter of the port 204 on the water heater 200. The diameter of the condenser coil 212 can be smaller than a length of the condenser coil 212 such that the condenser coil 212 portion of the condenser assembly 210 has a generally elongate shape and/or outline. The condenser coil 212 can include a helical portion 314 and a straight portion 316 (e.g., refrigerant return). That is to say, as illustrated, refrigerant can sequentially flow from a refrigerant inlet of the condenser assembly 210 (which can fluidly connect to one of the refrigerant lines 208), through a helical portion 314 of the condenser coil 212, and through a straight portion 316 to a refrigerant outlet of the condenser assembly 210 (which can fluidly connect to another refrigerant line 208). Alternatively, the refrigerant can sequentially flow from the refrigerant inlet, through the straight portion 316, and through the helical portion 314 of the condenser coil 212 to the refrigerant outlet (e.g., the helical portion 314 of the condenser coil 212 can be the return portion). As another alternative, the return portion (i.e., the portion of the condenser leading to the refrigerant outlet of the condenser assembly 210) can also be a spiral or helical portion of the condenser coil (e.g., an inner spiral within an outer spiral). While the return portion (e.g., the straight portion 316) is illustrated as being located within the interior volume defined by the helical portion 314, the disclosed technology is not so limited. Alternatively, the return portion (e.g., the straight portion 316) can be located outside the helical portion 314.

The condenser assembly 210 can extend into the tank 202 at any desired location. For example, the condenser assembly 210 can extend into the tank 202 from the top of the water heater 200 or from a side (e.g., vertically extending face) of the water heater 200. The condenser assembly 210 can extend into a bottom portion of the tank 202, as illustrated. Alternatively or in addition, the condenser assembly 210 (or an additional condenser assembly 210) can extend into an upper portion of the tank and/or a middle portion of the tank 202. The condenser assembly 210 can extend into the tank 202 in a generally radially inward direction (with respect to a central axis of the tank 202). Stated otherwise, a central axis of the condenser assembly 210 can intersect a central axis of the tank 202 (e.g., at a 90° angle or any other intersecting angle).

The condenser assembly 210 can include an aperture 318 through which the water inlet tube 320 can extend into the tank. The central axis of the water inlet tube 320 can be parallel to the central axis of the condenser assembly 210, and/or the water inlet tube 320 and the condenser assembly 210 can share a common central axis. Alternatively, at least a portion of the water inlet tube 320 can have an axis that is different from the central axis of the condenser assembly 210. The water inlet tube 320 can extend through an interior portion of the condenser coil 212 (i.e., inside the helical portion 214). Optionally, the condenser assembly 210 can include an alignment tab 319 configured to hold the extending end of the water inlet tube 320 in a predetermined position relative the condenser coil 212. The insertion of water into the tank 202 from within the interior portion of the condenser coil 212 can change the typical natural convection to forced convection, which can improve heat transfer as compared to traditional water heaters.

The water inlet tube 320 can have a length that is less than or equal to the length of the condenser coil 212 (i.e., the distance that the condenser coil 212 extends in the radial direction of the tank 202). The water inlet tube 320 can include one or more slits or apertures along at least a portion of the water inlet tube's 320 length. The slits and/or apertures can be located about some or all of the external diameter of the water inlet tube. The end of the water inlet tube 320 extending into the tank 202 can be capped (i.e., completely closed). Alternatively, the end of the water inlet tube 320 can include one or more apertures. By decreasing the amount of water entering the tank via the end of the water inlet tube 320, the amount of water entering the tank 202 via the slits and/or apertures along the length of the water inlet tube 320 can be increased, which can increase the amount of unheated water being immediately or nearly immediately directed across the condenser coil 212 upon introduction into the tank 202. This can, in turn, increase the heat transfer of the overall system.

The condenser assembly 210 can be detachably attachable to the water heater 200. For example, the condenser assembly 210 can attach to the water heater 200 via threads, as illustrated. For example, the water heater 200 can include a flange (e.g., integrated into the tank 202, welded to the tank 202) having threads on an inner diameter of an aperture in the flange, and the base 211 of the condenser assembly 210 can have a flange 313 with threads on an outer-facing surface such that the threads of the condenser assembly 210 can mate with the threads of the water heater 200. Alternatively, the condenser assembly 210 can attach to the water heater 200 via one or more clasps, one or more bolts, one or more nuts, and any other connector devices or techniques (e.g., mechanical connectors). Because the condenser assembly 210 can be removable from the water heater 200, the condenser assembly 210 can be easily repaired or replaced in the event of damage or failure, whereas traditional heat pump water heaters generally must be replaced in their entirety if there is damage to the wrap-around condenser coil.

As will be appreciated, water within a water heater tank can become stratified because hotter water is less dense than cold water. With traditional designs, the wrap-around condenser coil must be wrapped around a substantial portion of the tank to provide sufficient heating to the water in the tank. The disclosed technology, however, enables placement of the condenser coil at or near the bottom of the tank 202 where the water is coldest. This placement can increase or maximize the temperature differential between the hot refrigerant within the condenser coil 212 and the water surrounding the condenser coil 212, thereby enhancing and/or increasing heat transfer from the hot refrigerant to the water.

Figure 3A:
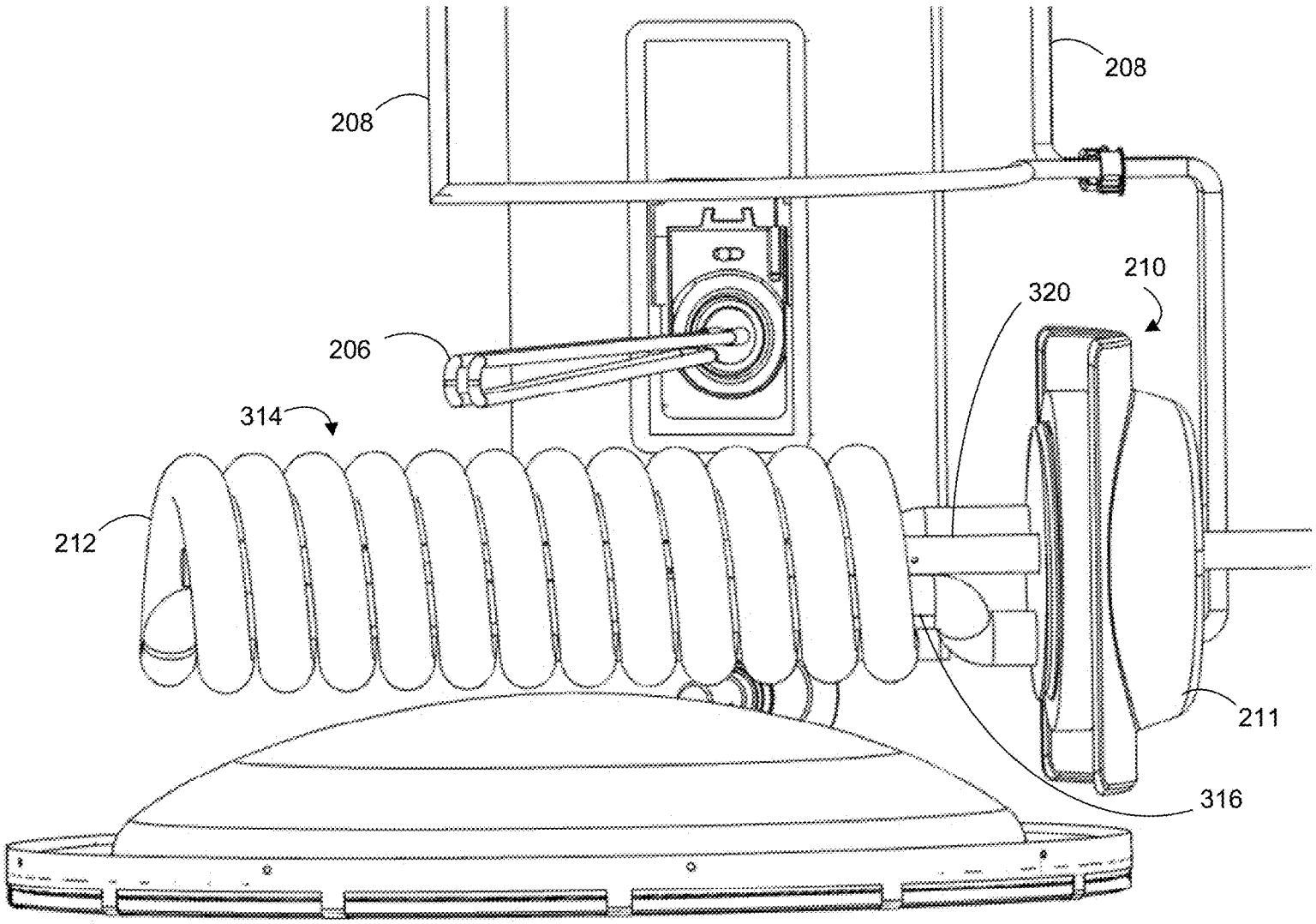
FIGS. 3A-3C illustrate views of an example condenser assembly and a water inlet tube, in accordance with the disclosed technology.
Figure 3B:
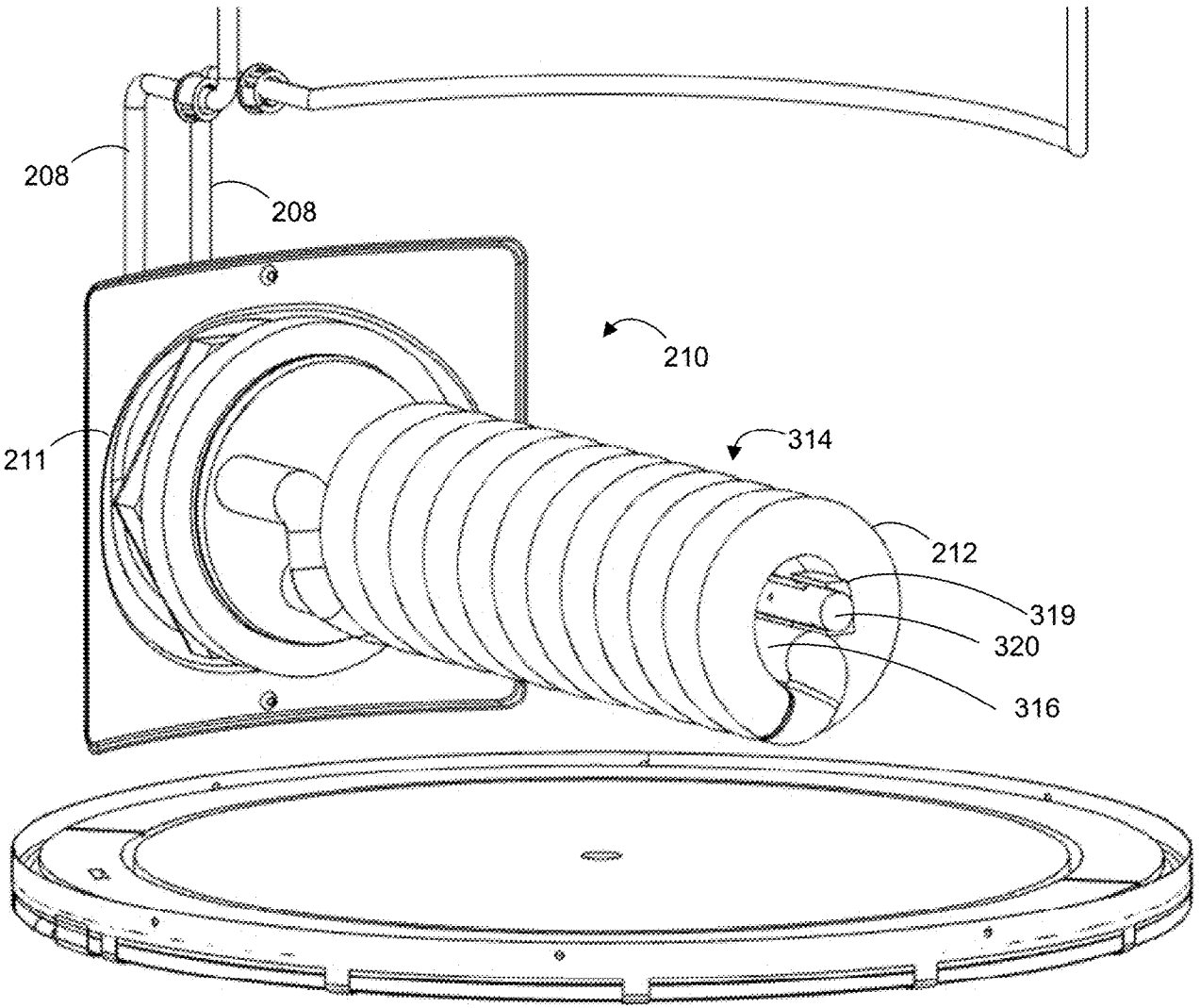
Figure 3C:
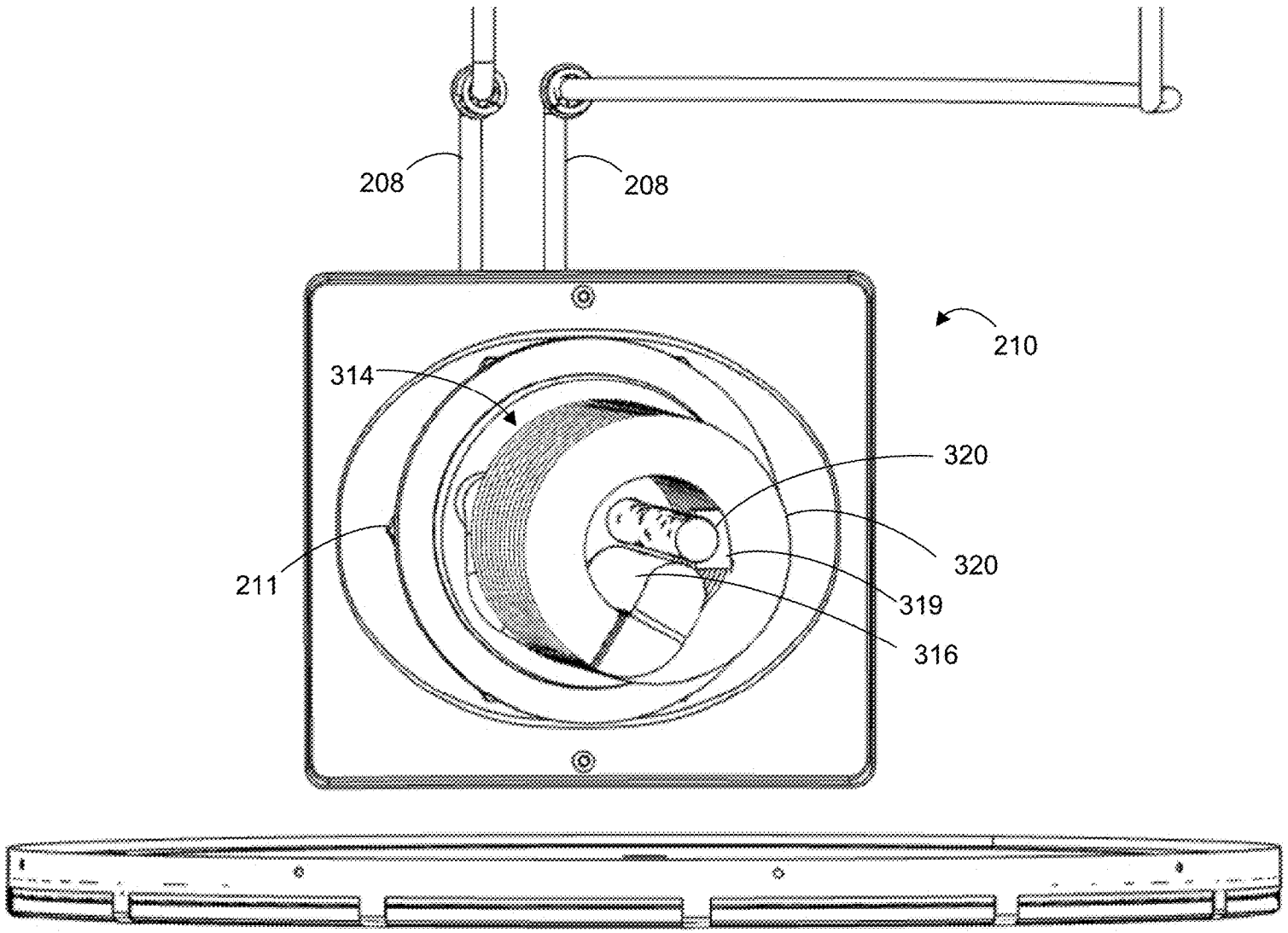
Figure 3D:
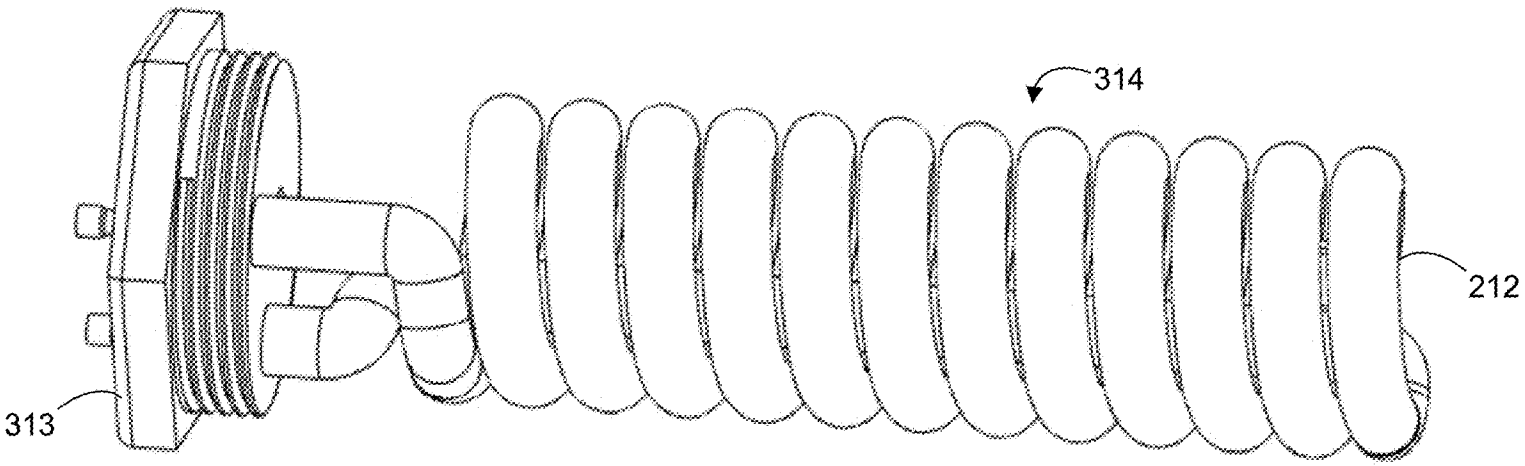
Figure 3E:
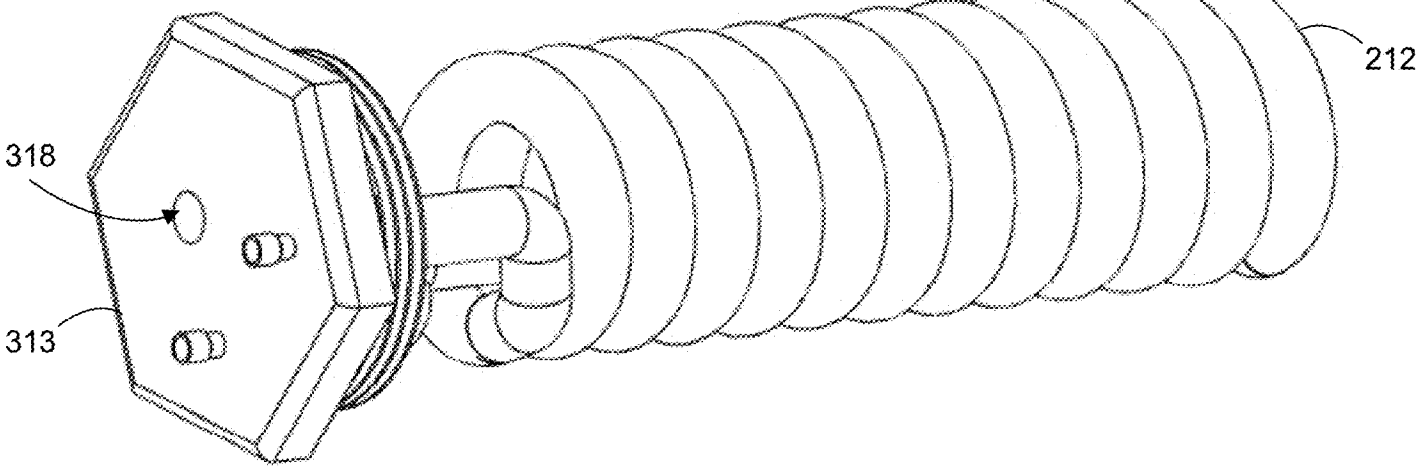
Figure 3J:
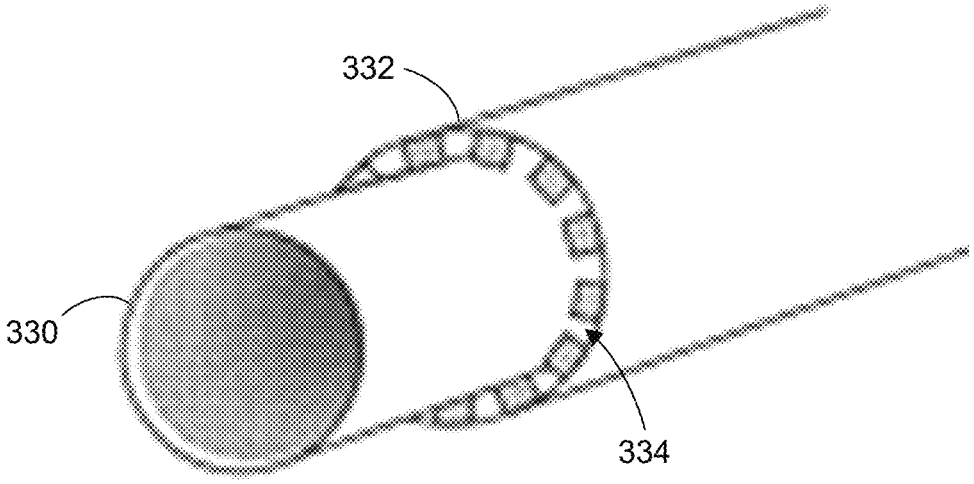
FIG. 3J illustrates cross-sectional view of an example condenser coil, in accordance with the disclosed technology.

Referring to FIG. 3J, the tube of the condenser coil 212 can have a double wall. That is to say, the tube of the condenser coil 212 can include an inner wall 330 and an outer wall 332, and there can be an air gap 334 between the inner wall 330 and the outer wall 332. The air gap 334 can serve as a refrigerant leak path should the inner wall 332 of the condenser coil 212 crack or otherwise become damaged. Furthermore, the condenser assembly 210 can include a leak detection system. For examples, the condenser assembly 210 can include a pressure sensor 336 in fluid communication with the air gap and in electrical communication with a controller. If the pressure sensor 336 detects a change in pressure within the air gap 334 (e.g., a pressure change that is above a predetermined threshold), the controller can determine there is a leak (e.g., refrigerant leak from inner wall of tube, water leak from outer wall of tube) and output a signal for deactivating the heat pump system and/or a signal for activating an outlet valve of the water heater 200 to prevent water from leaving the water heater.

To this point, the water inlet tube 320 has been described as extending a distance into the internal volume defined by the condenser coil 212. However, in some scenarios, the condenser coil 212 can be dimensioned such that there is insufficient clearance to accommodate the water inlet tube 320. Thus, it is contemplated that the water inlet tube 320 can stop before reach the condenser coil 212 or a portion thereof. For example, the water inlet tube 320 can extend into the tank 202 and can terminate at or before the start of the helical portion 314 of the condenser coil 212.

Moreover, the water inlet tube 320 can be omitted entirely. Instead, water can be streamed into the tank 202 via a water inlet (e.g., the aperture 318) that is configured to receive water from a water source. Optionally, the water inlet can include a water inlet nozzle. The water inlet nozzle can be configured to form a jet of the incoming water, and the jet of incoming water can be directed into the internal volume defined by the condenser coil 212. Thus, the benefits of the disclosed technology can be realized without the water inlet tube 320.

Figure 4B:
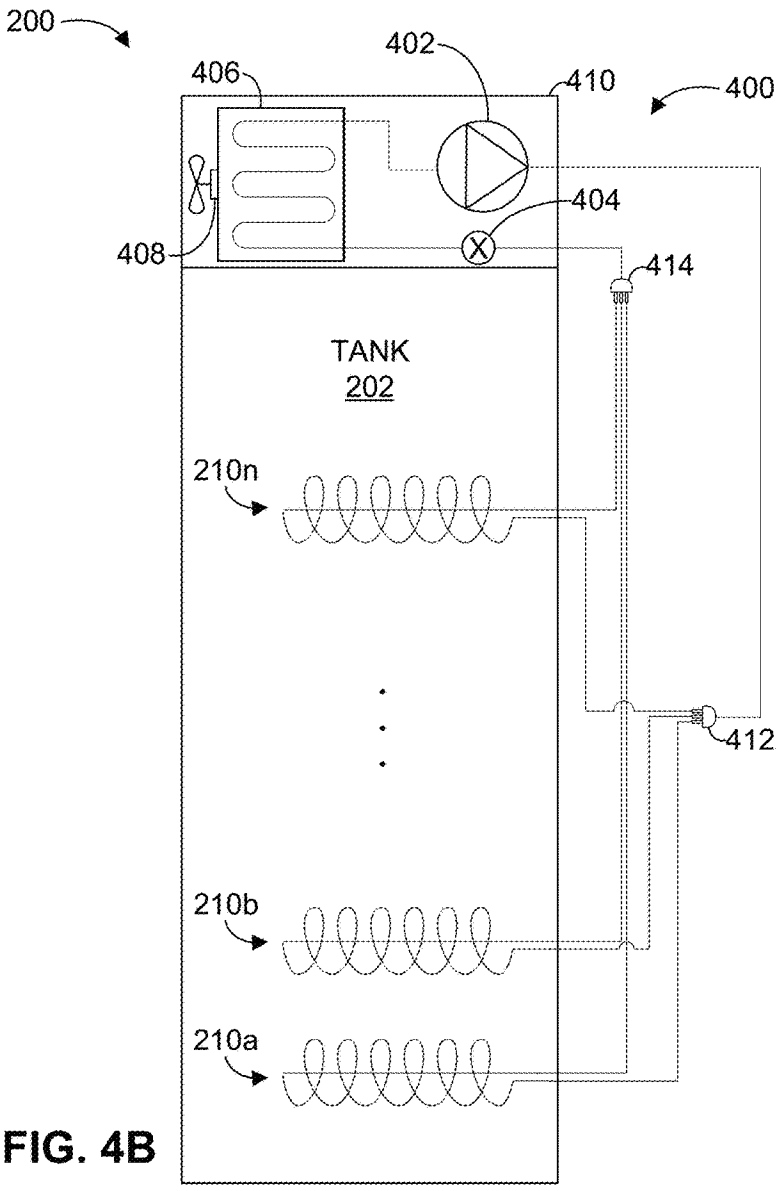
FIG. 4B illustrates a schematic diagram of an example water heater refrigerant flow path including multiple condenser assemblies in parallel, in accordance with the disclosed technology.
Figure 4A:
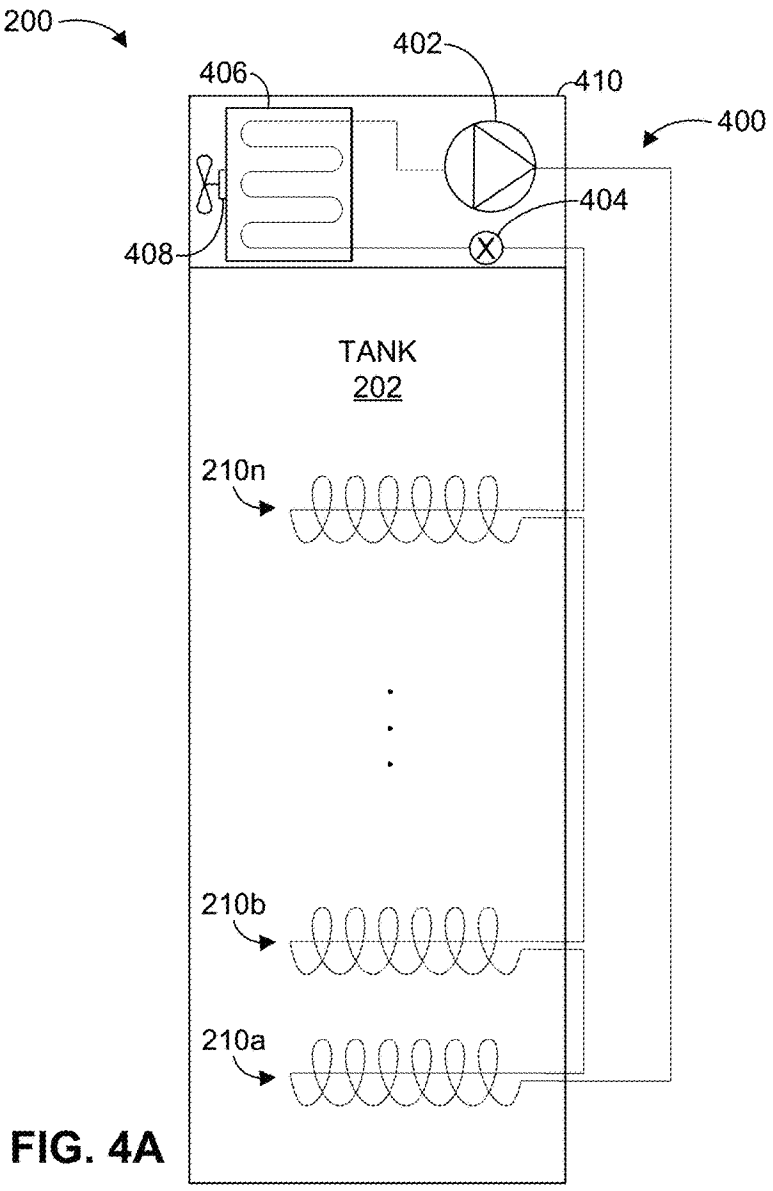
FIG. 4A illustrates a schematic diagram of an example water heater refrigerant flow path including multiple condenser assemblies in series, in accordance with the disclosed technology.

As previously discussed, the disclosed technology includes a water heater 200 having a heat pump that includes multiple condenser assemblies 210. Referring to FIGS. 4A and 4B, the water heater 200 can include two or more condenser assemblies 210 (labeled in FIGS. 4A and 4B as condenser assemblies 210*a*, 210*b*, . . . 210*n* and referenced cumulatively as condenser assemblies 210). Thus, the heat pump 400 of the water heater 200 can include a refrigerant circuit including a compressor 402, multiple condenser assemblies 210, an expansion valve 404, and an evaporator 406. The various components of the refrigerant circuit can be connected by various refrigerant lines.

Referring specifically to FIG. 4A, the condenser assemblies 210 can be arranged in series. That is, refrigerant can flow from the compressor 402 and flow sequentially through the first condenser assembly 210*a* and the second condenser assembly 210*b*. Depending on the number of condenser assemblies 210 included, the refrigerant can optionally flow through subsequent condenser assemblies 210 until the refrigerant exits the last condenser assembly 210*n* (which can be the second condenser assembly 210*b* if only two condenser assemblies 210 are included). After exiting the last condenser assembly 210*n*, the refrigerant can flow through the expansion valve 404 and the evaporator 406 to return to the compressor 402. To help facilitate heat transfer to ambient air, a blower or fan 408 can move ambient air across the evaporator 406. As illustrated, the compressor 402, expansion valve 404, evaporator 406, and fan 408 can be located in a common housing 410. The water heater 200 can include the housing 410 such that the housing and the tank 202 are included in a single unit. For example, the housing 410 can located above the tank 202 at an upper portion of the water heater 200. Alternatively, one, some, or all of the compressor 402, expansion valve 404, evaporator 406, and fan 408 can be located outside of the housing 410.

When arranged in series, the first condenser assembly 210*a* to receive refrigerant can be the lowermost location, and each successive condenser assembly 210 can be located at a progressively greater height. Thus, heat can be first transferred from the refrigerant to water at a low end of the tank 202 when the refrigerant is at its hottest. Because heat rises, the coldest water tends to be located at or near the bottom of the tank 202. Therefore, it can be beneficial to provide the hottest refrigerant to the lowermost condenser assembly to thereby transfer heat to the coldest water. As the initially heated water rises, it can be further heated by one or more subsequent condenser assemblies 210 that are each located at a height greater than the first condenser assembly 210*a*. Each of these subsequent condenser assemblies 210 can be configured to transfer heat from refrigerant that has already discharged some of its heat to water via one or more upstream condenser assemblies 210 (e.g., the first condenser assembly 210). In this way, additional heat can be transferred from the refrigerant to the water, which can improve the efficiency of the heat pump 400 and the water heater 200, overall.

As illustrated in FIG. 4B, the condenser assemblies 210 can be arranged in parallel. Refrigerant can flow from the compressor 402 to a refrigerant distributor or header 412*a*, which can split the single flow path of refrigerant received from the compressor 402 into a number of flow paths equal to the number of condenser assemblies 210 included in the water heater 200. The header 412 can be configured to equally divide the refrigerant between the various condenser assemblies 210. Regardless, refrigerant can simultaneously flow into each condenser assembly 210, and refrigerant can simultaneously flow out of each condenser assembly 210 to a refrigerant accumulator or header 414. The header 414 can be configured to simultaneously receive refrigerant from each condenser assembly 210 and output the refrigerant from each incoming flow path into a single flow path leading to the expansion valve 404. The headers 412, 414 can be the same, or the headers 412, 414 can be different components.

Although illustrated as being outside the housing 410, one or both of the headers 412, 414 can located inside the housing 410.

Regardless of whether the condenser assemblies 210 are arranged in series or parallel, at least one of the condenser assemblies 210 can extend radially inward from a sidewall of the tank 202. Alternatively or in addition, at least one of the condenser assemblies 210 can extend into the tank 202 from a bottom end of the tank 202 or a top end of the tank 202. Optionally, some or all of the condenser assemblies 210 can extend into the tank 202 from a common side of the tank 202. Alternatively, some of the condenser assemblies 210 can be located on a first side of the tank 202 and some of the condenser assemblies 210 can be located on a second side of the tank 202. The various condenser assemblies 210 can be configured to insert into the tank 202 in a rotating pattern. For example, when viewed from the top end of the tank 202, a first condenser assembly 210*a* can extend into the tank 202 from a generally 12:00 position, a second condenser assembly 210*b* can extend from a generally 3:00 position, a third condenser assembly 210*c* can extend from a generally 6:00 position, and a fourth condenser assembly 210*c* can extend from a generally 9:00 position. The condenser assemblies 210 can be evenly spaced along the periphery of the tank 202 (e.g., equal arc lengths between adjacent condenser assemblies 210 when viewed from the top end of the tank 202). Alternatively, the spacing between adjacent pairs of condenser assemblies 210 can vary.

The various condenser assemblies 210 can be arranged at different positions along a height of the tank 202. Stated otherwise, the various condenser assemblies 210 can be located at different heights. The lowermost condenser assembly 210*a* can be located at a first height, and each successive condenser assembly 210 can be located at a height that is greater than the first height. For example, each successive condenser assembly 210 can be located at a progressively greater height. The various condenser assemblies 210 can be evenly spaced such that there is an equal distance between each pair of adjacent condenser assemblies 210. Alternatively or in addition, the condenser assemblies 210 can be evenly spaced along the height of the tank 202. Alternatively, the distance between each pair of adjacent condenser assemblies 210 can vary.

As discussed herein, a given condenser assembly 210 can include a water inlet tube 320 extending into the tank 202 through the interior volume defined by condenser coil 212 of the condenser assembly 210 or a water inlet nozzle configured to discharge incoming water into the interior volume defined by condenser coil 212 of the condenser assembly 210. If the water heater 200 includes multiple condenser assemblies 210, one, some, or all of these condenser assemblies 210 can include a water inlet tube 320 or water inlet nozzle. For example, only the lowermost condenser assembly 210 can include a water inlet tube 320 or water inlet nozzle. Alternatively, two or more of the condenser assemblies 210 (e.g., the two lowest condenser assemblies 210) can include a corresponding water inlet tube 320 or water inlet nozzle. If multiple water inlet tubes 320 are included, the water heater 200 can include a manifold that can receive water from a water source and divide that single incoming flow of water into an outgoing flow of water for each condenser assembly 210 (e.g., in a manner similar to that of the header 412).

Figure 5:
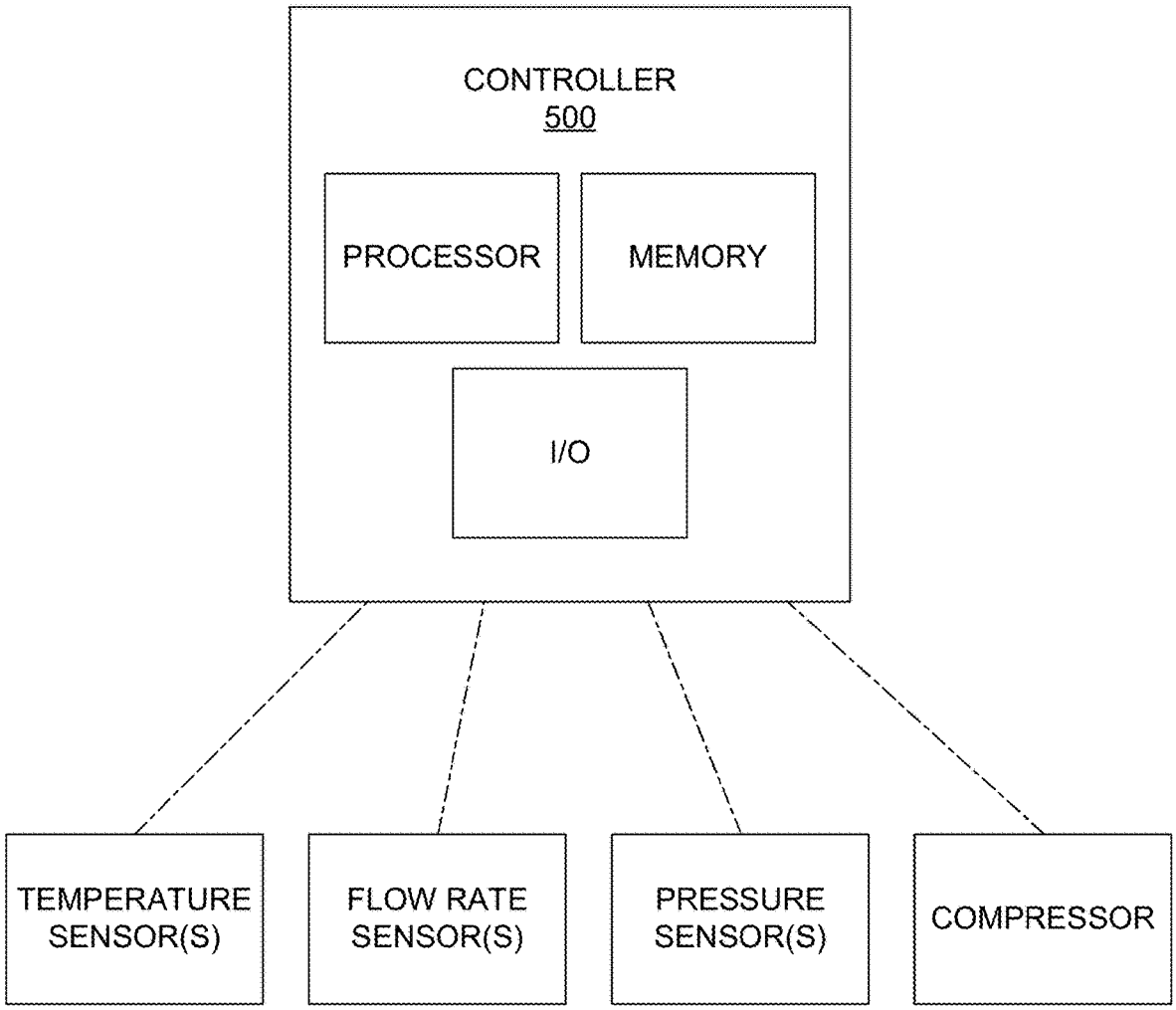
FIG. 5 illustrates a schematic diagram of an example heat pump water heater, in accordance with the disclosed technology.

Referring to FIG. 5, the water heater 200 can include the controller 500 having one or more processors and memory having instructions stored thereon that, when executed by the one or more processors, cause the controller 500 to perform certain actions. The controller 500 can be in communication with an input/output device for receiving information from, and/or displaying information to, a user. The controller 500 can be in communication with one or more temperature sensors, one or more flow rate sensors, one or more pressure sensors (e.g., the pressure sensor 336 of the leak detection system disclosed herein), and the compressor of the heat pump.

Figure 6:
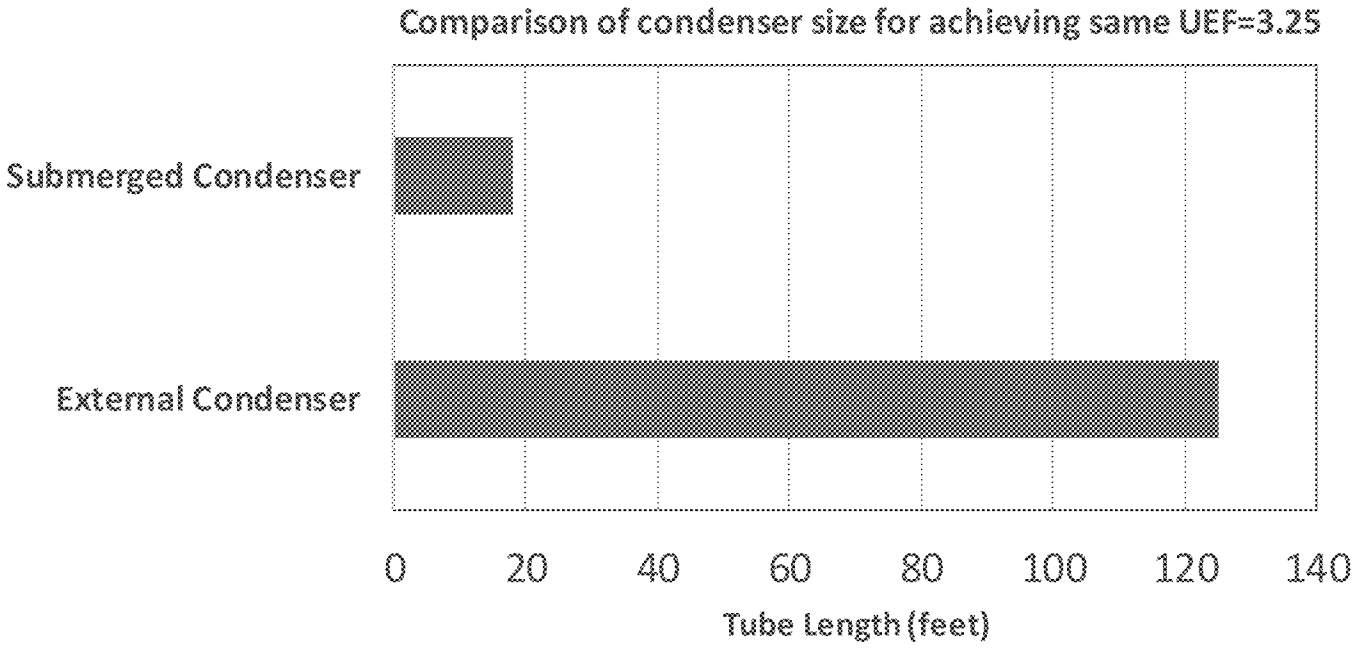
FIG. 6 illustrates a graph indicating the difference in tube length required for an example condenser assembly according to the disclosed technology as compared to a wrap-around condenser of a prior art heat pump water heater.

Referring to FIG. 6, a graph depicts the condenser coil tube length required to achieve a Uniform Energy Factor (UEF) of 3.25 for both a submerged condenser 210 according to the disclosed technology and a traditional wrap-around or external condenser. The data depicted by the graph is based on simulations performed using the ORNL Heat Pump Design Model (HPDM). Identical tubing with a smooth exterior and the same number of wraps were used for the submerged condenser and the external condenser in the simulation. The submerged condenser was positioned in the bottom of the tank, and the external condenser was wrapped around the outside the tank to avoid the regions of the tank where valve connections and a thermistor bracket are located. According to the HPDM simulations, the submerged configuration uses only 14.3% of the tube length used by the wrap-around configuration, reducing the total tube length from 125 feet to 17.86 feet.

While certain aspects and/or embodiments of the disclosed technology have been described in connection with what is presently considered to be the most practical embodiments, it is to be understood that the disclosed technology is not to be limited to the disclosed embodiments, but on the contrary, is intended to cover various modifications and equivalent arrangements included within the scope of the appended claims. Although specific terms are employed herein, they are used in a generic and descriptive sense only and not for purposes of limitation.

What is claimed is:

1. A condenser assembly comprising:

a condenser coil having:

a first portion configured to fluidly communicate with a first refrigerant line of a heat pump, the first portion having a plurality of windings defining an internal volume; and a second portion configured to fluidly communicate with a second refrigerant line of the heat pump; and a water inlet tube at least partially extending through the internal volume of the first portion, wherein the water inlet tube has a plurality of apertures disposed along at least a majority of a length of the water inlet tube, the plurality of apertures configured to discharge incoming water into the internal volume.

2. The condenser assembly of claim 1, wherein the plurality of windings of the first portion form a helix.

3. The condenser assembly of claim 1, wherein the condenser coil is configured to sequentially pass refrigerant through the first portion and the second portion.

4. The condenser assembly of claim 1, wherein the condenser coil is configured to sequentially pass refrigerant through the second portion and the first portion.

5. The condenser assembly of claim 1, wherein the second portion comprises a substantially straight section.

6. The condenser assembly of claim 1, wherein the second portion extends through the internal volume of the first portion.

7. The condenser assembly of claim 1, wherein the second portion extends outside the internal volume of the first portion.

8. The condenser assembly of claim 1, further comprising:
a base configured to detachably attach to a receiving port of a water heater.

9. The condenser assembly of claim 8, wherein the base comprises threads configured to mate with threads of the receiving port.

10. The condenser assembly of claim 1, wherein the condenser coil extends from a base comprising an aperture configured to receive the water inlet tube.

11. The condenser assembly of claim 1, wherein the water inlet tube has a length that is less than or equal to a length of the condenser coil.

12. The condenser assembly of claim 1, wherein the water inlet tube has a capped end.

13. The condenser assembly of claim 1, further comprising an alignment tab mounted to the first portion and configured to hold the water inlet tube in a predetermined position relative to the condenser coil.

14. The condenser assembly of claim 1, wherein the condenser coil comprises an inner wall and an outer wall, the inner and outer walls forming an air gap therebetween.

15. The condenser assembly of claim 1, wherein a longitudinal axis of the condenser coil is substantially horizontal within the tank, and wherein a distal end of the water inlet tube is substantially horizontal and is disposed within the internal volume.

16. The condenser assembly of claim 1, wherein the plurality of apertures are disposed circumferentially on all sides of the water inlet tube.

17. The condenser assembly of claim 1, wherein the plurality of apertures are disposed within the internal volume.

18. A water heater comprising:
a tank; and
a heat pump comprising a refrigerant circuit including a compressor, an evaporator, an expansion valve, a condenser assembly, and a plurality of refrigerant lines, the condenser assembly comprising:
a condenser coil comprising:
a first portion configured to fluidly communicate with a first refrigerant line of the plurality of refrigerant lines, the first portion (i) having a plurality of windings defining an internal volume and (ii) being configured to at least partially extend into an internal volume of the tank; and
a second portion configured to fluidly communicate with a second refrigerant line of the plurality of refrigerant lines and to at least partially extend into the internal volume of the tank; and
a water inlet tube at least partially extending through the internal volume of the first portion, wherein the water inlet tube has a plurality of apertures disposed along at least a majority of a length of the water inlet tube, the plurality of apertures configured to discharge incoming water into the internal volume of the first portion.

19. The water heater of claim 18, further comprising a receiving port, wherein the condenser assembly is configured to detachably attach to the receiving port.

20. The water heater of claim 19, wherein the receiving port is located in a sidewall of the water heater.

* * * * *